United States Patent [19]

Borgstedt

[11] 4,427,527

[45] Jan. 24, 1984

[54] COAL HYDROGENATION IN A LIQUID METALLIC MEDIUM

[75] Inventor: Hans U. Borgstedt, Karlsruhe, Fed. Rep. of Germany

[73] Assignee: Kernforschungszentrum Karlsruhe GmbH, Karlsruhe, Fed. Rep. of Germany

[21] Appl. No.: 330,455

[22] Filed: Dec. 14, 1981

[30] Foreign Application Priority Data

Dec. 13, 1980 [DE] Fed. Rep. of Germany ..... 3047050

[51] Int. Cl.[3] ..... C10G 1/00

[52] U.S. Cl. ..... 208/8 R; 208/10; 208/125; 585/700; 48/210

[58] Field of Search ..... 208/8 R, 10, 125; 585/700; 48/210, 92

[56] References Cited

U.S. PATENT DOCUMENTS

| | | | |
|---|---|---|---|
| 3,790,468 | 2/1974 | Loth | 208/10 |
| 3,790,469 | 4/1972 | Loth | 208/10 |
| 3,844,928 | 10/1974 | Geymer | 208/10 |
| 3,966,582 | 6/1976 | Cramer | 208/8 R |
| 3,966,583 | 6/1976 | Cramer | 208/8 R |
| 4,092,236 | 5/1978 | Heredy | 208/10 |

OTHER PUBLICATIONS

PCT #WO80/02151 to Mayes, U.S. Priority Date: Apr. 2, 1979, Publication Date: Oct. 16, 1980.

J. W. Mausteller, "3.3 Cold Trapping", *Alkali Metal Handling and Systems Operating Techniques,* (1967), pp. 46 to 52.

*Primary Examiner*—Delbert E. Gantz
*Assistant Examiner*—Lance Johnson
*Attorney, Agent, or Firm*—Spencer & Frank

[57] ABSTRACT

A process for the hydrogenation of coal which comprises introducing a hydrogen containing gas into a substantially saturated solution of carbon in a metallic medium at a temperature below 900° K. to convert C and H to hydrocarbon compounds within the medium.

20 Claims, 1 Drawing Figure

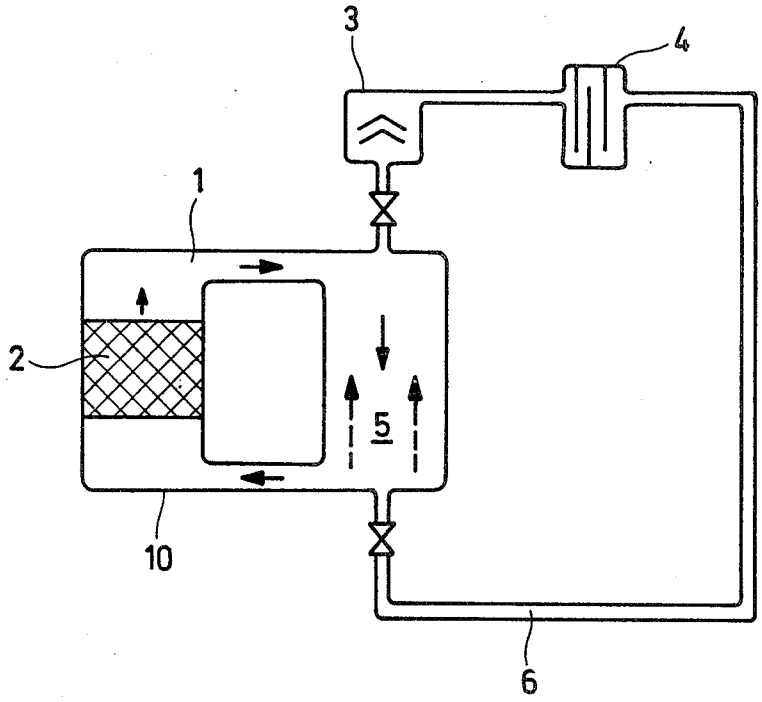
3
4
1
2
5
10
6

COAL HYDROGENATION IN A LIQUID METALLIC MEDIUM

BACKGROUND OF THE INVENTION

The present invention relates to a coal hydrogenation process.

For decades, the Fischer-Tropsch process has been used for the complete synthesis of hydrocarbons. This method employs a synthesis gas containing carbon monoxide and hydrogen as the starting materials, and operates with relatively low pressures of up to about 10 bar and at relatively low temperatures of about 473° K. The coal hydrogenation process according to Fischer-Tropsch is performed with a sufficient supply of energy according to the following reaction equation:

$$x(CO)+x(2H_2)\rightarrow x(CH_2)+x(H_2O)$$

In the known Fischer-Tropsch process, the synthesis gas must be as free as possible of sulfur compounds which would otherwise poison the required catalysts. In the past, such poisoning phenomena made coal hydrogenation processes questionable with respect to their yield or as a whole.

The energy crisis that has occurred in recent years and the continued increase in the price of crude oil has resulted in a worldwide search these past years for cost efficient coal hydrogenation processes or coal refining processes and this search is still continuing.

SUMMARY OF THE PRESENT INVENTION

It is an object of the present invention to provide a new coal hydrogenation process which can be performed not only economically but also simply and requires only a relatively small amount of apparatus, monitoring equipment and personnel. A further object of the present invention is to provide a robust coal hydrogenation process, i.e., a process in which the coal hydrogenation reaction can take place in the presence of certain impurities.

Another object of the present invention is to provide a process which does not suffer from poisoning.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, the present invention provides a process for the hydrogenation of coal comprising feeding a hydrogen containing gas to a substantially saturated solution of carbon in a metallic medium at a temperature below 900° K., to convert the C and H to hydrocarbon compounds within the medium.

In the process according to the present invention, the conversion reaction between C and H is preferably performed in a metal melt.

In an advantageous embodiment of the process according to the present invention: (a) the liquid metal melt is conducted through a coal containing bed and circulated so as to substantially saturate the melt with carbon; (b) the hydrogen containing gas is fed into the metal melt, which has been substantially saturated with C, to react part of the hydrogen with a corresponding part of the dissolved carbon to form hydrocarbon compounds containing a major proportion of methane; (c) the hydrogen containing gas receives the formed hydrocarbon compounds and carries them along, and is extracted from the metal melt to remove the reaction products (hydrocarbon compounds) from the reaction equilibrium; (d) the reaction products are separated from the gas, and the gas which has been freed from the reaction products is circulated back into the metal melt.

The metal melt preferably is formed of at least one alkali metal and the alkali metal employed preferably is lithium, sodium, potassium or a mixture thereof. Advantageously, the conversion reaction takes place at a temperature in the range of 673° K. to 873° K. The hydrogen containing gas preferably is fed into the metal melt at a pressure in the range from 1.5 bar to 15 bar.

In an advantageous embodiment of the process according to the present invention, the hydrocarbon compounds are separated from the gas extracted from the metal melt with the aid of condensation and/or absorption.

It is to be understood that both the foregoing general description and the following detailed description are exemplary, but are not restrictive of the invention.

BRIEF DESCRIPTION OF THE DRAWINGS

The sole drawing is a schematic representation for the hydrogenation of coal in an alkali metal melt in accordance with the process of the present invention.

DETAILED DESCRIPTION OF THE INVENTION

Liquid alkali metals are solvents for non-metallic elements, and the nonmetallic elements are able to react with one another in solution in the liquid alkali metal. If, for example, hydrogen in its elemental form is added to liquid sodium having a certain carbon concentration, corresponding to an associated defined chemical activity for the carbon, the measurable carbon activity in the sodium is immediately reduced. Consequently, hydrocarbons are formed according to equation (1).

$$C+2H_2\rightleftarrows CH_4 \quad (1)$$

The equilibrium is established quickly, since both the carbon and hydrogen elements are dissolved in alkali metals in the form of poorly stable alkali metal compounds such as $Na_2C_2$ and NaH. Equation (1) could therefore also be written in the form of equation (2).

$$\tfrac{1}{2}Na_2C_2+4NaH\rightleftarrows CH_4+5Na \quad (2)$$

Corresponding reactions can be observed in the alkali metals lithium and potassium.

The thermochemical conditions for the formation of hydrocarbon are the most favorable the lower the reaction temperature is kept. Since the values for the free formation enthalpies (the $\Delta H_f^\circ$ values), for example for the formation of $Na_2C_2$ and NaH, lie, at 673° K. to 773° K. and in the region of their saturation concentrations, near zero, the equilibrium according to equation (1) will practically not shift at all due to the presence of sodium.

Table 1 below lists the free formation enthalpies for the formation of methane from the elements at 400° and 600° C., the derived values of chemical activity of carbon in equilibrium $a_C$, and the relationships of the partial pressures $p_{H2}/p_{CH4}$.

TABLE 1

| Thermochemical Data for Methane Formation at 400° and 600° C. | | | | |
|---|---|---|---|---|
| t(°C.) | T(K) | $H_f$(cal/Mol) | $a_C$ | $p_{H_2}/p_{CH_4}$ |
| 400 | 673.2 | −13350 | $4.5 \cdot 10^{-5}$ | $6.7 \cdot 10^{-3}$ |
| 600 | 873.2 | −10800 | $1.9 \cdot 10^{-3}$ | $4.4 \cdot 10^{-2}$ |

It is clearly of advantage to conduct the reaction at as low a temperature as possible. Experiments have shown that this enhances the formation of methane. The drawbacks of the slow reaction rate caused by the low temperature are overcome by the advantages of conducting the reaction in solution, i.e. for example in an alkali metal melt.

In order to conduct the reaction in solution, solid carbon is added in excess to the alkali metal to provide a substantially C-saturated solution, that is, a saturated or almost saturated solution, and a steady stream of hydrogen is run through the substantially C-saturated solution. Initially, this causes the carbon and hydrogen to be dissolved in the sodium where they react to form hydrocarbon. The hydrocarbon formed by the above-mentioned reaction, in the simplest case $CH_4$, goes into the gaseous phase and is thus removed from the reaction medium and reaction equilibrium. This removal of the formed hydrocarbons from the reaction equilibrium and reaction medium, as well as the use of hydrogen containing gas pressures slightly higher than atmospheric, preferably pressures in the range between 5 and 15 bar, enhances the formation of hydrocarbons. The excess solid carbon in the alkali metal ensures that the carbon concentration is always constant.

Both the carbon and hydrogen elements are more soluble in lithium than in the other alkali metals. The solubility of the hydrocarbons in the alkali metals is not known. The amount of dissolved hydrocarbons must be kept low by continuous removal of them from the carrier gas, after passing the alkali metal, for the solubility depends on their partial pressures. The removal of hydrocarbons from the gas causes the low partial pressure. Removal can be made by condensation or absorption, etc.

The solubility of hydrogen at 1 bar and of carbon in the range of reaction temperatures which can be used in the present invention are listed in Table 2.

TABLE 2

| Solubility of Hydrogen and Carbon in the Alkali Metals Lithium and Sodium | | | | | |
|---|---|---|---|---|---|
| | Hydrogen | | Carbon | | |
| | 673° K. | 873° K. | 673° K. | 873° K. | |
| Lithium | 1.2 | 7.5 | 0.01 | 0.1 | Weight % |
| Sodium | 0.12 | 0.25 | $10^{-5}$ | $10^{-3}$ | Weight % |

In the process according to the present invention for hydrogenating coal, the alkali metal and the hydrogen-containing gas are advantageously circulated. Referring now to the drawing figure, there is shown a schematic representation of a system for the hydrogenation of coal in an alkali metal melt. The system includes a container 10 in which a liquid alkali metal can be circulated in the direction shown by the full line arrows. One side of the container 10 is provided with a coal containing carbon bed 2 and the other side of container 10 serves as a reaction chamber 5 and is connected to a gas circuit 6. The alkali metal 1 passes through carbon bed 2 at 673° K. to 873° K. where it can saturate with C. In the other part of the liquid circuit (reaction chamber 5), hydrogen is fed (pressed) into the liquid metal in the direction shown by the broken-line arrows (countercurrent to the liquid flow), passes through the melt and returns to gas circuit 6 through a liquid metal separator 3. In this gas circuit 6, care must now be taken that the formed hydrocarbon is separated, for example through condensation or absorption with the aid of a hydrocarbon separator 4.

The carbon supply may be of industrial quality since the alkali metals dissolve selectively. Sulfur would be substantially retained in the liquid melt as $Na_2S$ and could be separated in a cold trap in an ancillary circuit, not shown in the drawing. The hydrogen preferably should be nitrogen free or contain only a small amount of nitrogen since the presence of the latter may lead to annoying byproducts. Preferably, industrial hydrogen or hydrogen which has been diluted with a noble gas is used as the hydrogen containing gas. The dilution can be in the range down to 10 Vol. % of hydrogen in the gas mixture.

Such a system permits the synthesis of hydrocarbon from the elements at relatively low temperatures of 673° K. to 873° K., preferably 773° K., and at low pressures. The necessary apparatus can be manufactured from known materials. The alkali metal is consumed only in small amounts by reactions with impurities in the starting materials. The solvent and reaction medium are extremely inexpensive in the case of sodium, less so in the case of lithium. The technology of alkali metal melts in industrial systems has already been tested in the nuclear energy art and does not present any impediment in the implementation of the process according to the present invention.

The invention will now be explained in greater detail with the aid of exemplary experiments. However, the invention is not limited to these experiments.

RESULTS OF EXPERIMENTS FOR SETTING THE EQUILIBRIUM OF HYDROCARBON FORMATION IN LIQUID SODIUM AT 673° K. AND 773° K.

Three experiments were performed in an apparatus containing roughly 50 liters of circulating sodium. The apparatus was not designed for synthetic experiments, i.e. was of not particularly suitable design for the process according to the present invention.

However, for sodium examinations, the sodium circuit was equipped with monitors for measuring carbon activities and hydrogen partial pressures. The hydrogen containing gas used in the experiments was diluted with argon, which served as protective gas, and could be analyzed by means of a gas chromatograph as to its content of hydrogen and the hydrocarbons methane and ethane. The hydrogen containing gas was fed into the sodium with an argon pressure of 1.5 bar.

Hydrogen was introduced into the sodium through an iron membrane. Since in the available apparatus fabricated of stainless steel the carbon contents lay below the saturation concentration and carbon could not be replenished for the reaction, the chemical activity was about $10^{-1}$ at 673° K. and $10^{-2}$ at 773° K. In the three experiments, results were obtained regarding the formation of hydrocarbons in liquid sodium at 673° K. to 773° K.

EXPERIMENT NO. 1

In this experiment, the sodium was maintained at 773° K. and initially had a carbon activity of $10^{-2}$. In this sodium at 773° K., an initial hydrogen partial pressure of about $10^{-4}$ bar was obtained, and this partial pressure was maintained for the duration of the experiment by feeding hydrogen into the sodium by diffusion through an iron membrane. The carbon activity dropped during the experiment from $10^{-2}$ to about $10^{-3}$, in a period of about 10 minutes, and during this period a hydrocarbon partial pressure of about $1.5 \cdot 10^{-4}$ bar developed. The hydrocarbon partial pressure was measured in samples which were taken from the protective gas after the protective gas passed through the liquid sodium. In addition to $CH_4$, $C_2H_6$ and higher hydrocarbons were detected in the samples. The $CH_4$ yield was roughly 4 mg/h.

EXPERIMENT NO. 2

(Control Experiment for Experiment No. 1 With Insufficient Supply of H)

The same conditions were used as in Experiment No. 1, except that the hydrogen partial pressure in the sodium was lowered to a level of about $10^{-6}$ bar by cooling the iron membrane. With such a small supply of hydrogen in the sodium, no reduction of the carbon activity value to below $10^{-2}$ was noted even after several hours. The hydrocarbon partial pressures in the protective gas leaving the sodium, and which are a measure of the hydrocarbon content, were at $1 \cdot 10^{-6}$ to $5 \cdot 10^{-6}$ bar.

EXPERIMENT NO. 3

In this experiment, the sodium was maintained at 673° K. and initially had a carbon activity of $10^{-1}$. In this sodium at 673° K., a hydrogen partial pressure of about $10^{-4}$ bar was maintained. The chemical activity of the carbon ($10^{-1}$) at the lower temperature (as compared to Experiment No. 1) dropped during the experiment by two orders of magnitude, that is, to about $10^{-3}$ in about a period of about 20 minutes. In this about 20 minute period, a hydrocarbon pressure of about $8.5 \cdot 10^{31\ 4}$ developed in the argon protective gas leaving the liquid sodium. The gas chromatograph recorded, in addition to $CH_4$, also $C_2H_6$ and higher hydrocarbons in the gas leaving the liquid sodium. The $CH_4$ yield in this case was about 12 mg/h.

The experiments proved the following:

(a) hydrocarbon developed from carbon dissolved in sodium and hydrogen and changed to the gaseous phase;

(b) more hydrocarbon developed at a lower temperature; at a higher temperature the reaction was faster;

(c) higher contents or chemical activities of carbon and hydrogen resulted in larger quantities of developed hydrocarbon.

In Experiments Nos. 1 and 3, the yield was high with respect to the carbon employed, as was to be expected according to the equilibrium calculations.

In view of the favorable equilibrium position and the observed high reaction rate, this process constitutes an industrially feasible way for coal hydrogenation at low temperatures and pressures.

Parameters which may influence the reaction with respect to equilibrium or kinetics are:

(a) temperature, with respect to equilibrium position the lower level of 673° K. gives the best results, with respect to kinetics higher temperatures up to 823° K. are favorable;

(b) pressure of hydrogen influences yield, with higher pressures giving better yield; and (c) the finer the grains of coal the faster the dissolution rate and thus the kinetics.

Solid particles of coal can be suspended in liquid alkali metals and can react in this form with hydrogen. Suspension can be made by introducing fine grained coal into the coal bed which is passed by the sodium. Suspended particles will be dissolved when carbon is consumed by the hydrocarbons formation, thus keeping the chemical activity of carbon in sodium close to unity. The reaction mechanism is not changed by the use of the suspended coal, but the procedure to disolve carbon in sodium.

Since the relationship of methane to heavier hydrocarbons depends on the coal quality as well as on some reaction parameters, one can only give rough limitations, in our examples about 90% $CH_4$.

It will be understood that the above description of the present invention is susceptible to various modifications, changes, and adaptations, and the same are intended to be comprehended within the meaning and range of equivalents of the appended claims.

What is claimed is:

1. Process for the hydrogenation of coal, comprising contacting coal with a liquid metallic medium to dissolve the coal in the liquid metallic medium and form a substantially saturated solution of carbon (C) in the liquid metallic medium, the liquid metallic medium being conducted through a coal-containing bed and circulated in order to substantially saturate it with carbon, and introducing a hydrogen containing gas into the substantially saturated solution of carbon in the liquid metallic medium at a temperature below 900° K. to convert the dissolved C and H to hydrocarbon compounds within the medium.

2. Process as defined in claim 1, wherein the liquid metallic medium in which the conversion reaction between C and H is performed is an alkali metal melt.

3. Process as defined in claim 1, wherein the hydrogen containing gas is fed into the liquid metallic medium, which has been substantially saturated with C, to react part of the hydrogen with a corresponding part of the dissolved carbon to form hydrocarbon compounds containing a major proportion of methane;

the hydrogen containing gas receives and carries along the formed hydrocarbon compounds, and is extracted from the liquid metallic medium to remove the hydrocarbon compounds from the reaction equilibrium;

the hydrocarbon compounds are separated from the gas, and the gas, freed from the hydrocarbon compounds, is returned to circulation in the liquid metallic medium.

4. Process as defined in claim 2, wherein the metal melt is formed of at least one alkali metal selected from lithium, sodium, potassium or a mixture thereof.

5. Process as defined in claim 4, wherein the conversion reaction is performed at a temperature in the range from 673° K. and 873° K.

6. Process as defined in claim 2, wherein the hydrogen containing gas is fed into the metal melt at a pressure in the range from 1.5 bar to 15 bar.

7. Process as defined in claim 1, wherein a nitrogen free gas or a gas poor in nitrogen is used as the hydrogen containing gas.

8. Process as defined in claim 7, wherein industrial hydrogen or hydrogen which has been diluted with a noble gas is used as the hydrogen containing gas.

9. Process as defined in claim 8, wherein the hydrocarbon compounds are separated from the gas extracted from the liquid metallic medium by condensation and/or absorption.

10. Process as defined in claim 1, wherein the hydrogen containing gas is conducted countercurrent to the saturated solution.

11. Process as defined in claim 1, wherein an excess of solid coal is added to the metallic medium to provide and maintain the saturated solution.

12. Process as defined in claim 1, wherein the coal is contacted with the metallic medium in a first zone to form the saturated solution, and the saturated solution is conveyed to a reaction zone where the hydrogen containing gas is introduced.

13. Process as defined in claim 1, wherein the liquid metallic comprises a sodium liquid melt and the coal contains sulfur which is substantially retained in the liquid melt as $Na_2S$, and further comprising separating the sulfur from the liquid melt in a cold trap.

14. Process as defined in claim 1, wherein solid particles of coal are suspended in the liquid metallic medium.

15. Process for the hydrogenation of coal, comprising contacting coal with a liquid metallic medium to dissolve the coal in the liquid metallic medium and form a substantially saturated solution of carbon (C) in the liquid metallic medium, and introducing a hydrogen containing gas into the substantially saturated solution of carbon in the liquid metallic medium at a temperature below 900° K. to convert the dissolved C and H to hydrocarbon compounds within the medium, with the hydrogen-containing gas being conducted countercurrent to the saturated solution.

16. Process as defined in claim 15, wherein the liquid metallic medium in which the conversion reaction between C and H is performed is an alkali metal melt.

17. Process as defined in claim 15, wherein (a) the liquid metallic medium is conducted through a coal-containing bed and circulated in order to substantially saturate it with carbon;

(b) the hydrogen containing gas is fed into the liquid metallic medium, which has been substantially saturated with C, to react part of the hydrogen with a corresponding part of the dissolved carbon to form hydrocarbon compounds containing a major proportion of methane;

(c) the hydrogen containing gas receives and carries along the formed hydrocarbon compounds, and is extracted from the liquid metallic medium to remove the hydrocarbon compounds from the reaction equilibrium;

(d) the hydrocarbon compounds are separated from the gas, and the gas, freed from the hydrocarbon compounds, is returned to circulation in the liquid metallic medium.

18. Process as defined in claim 16, wherein the liquid metallic medium is formed of at least one alkali metal selected from lithium, sodium, potassium or a mixture thereof.

19. Process as defined in claim 18, wherein the conversion reaction is performed at a temperature in the range from 673° K. and 873° K.

20. Process as defined in claim 15, wherein an excess of solid coal is added to the metallic medium to provide and maintain the saturated solution.

* * * * *